US007584640B1

(12) United States Patent
Liu et al.

(10) Patent No.: US 7,584,640 B1
(45) Date of Patent: Sep. 8, 2009

(54) PRESS BRAKE TOOL

(75) Inventors: Yi-Hua Liu, Shenzhen (CN); Fu-Shun Huang, Taipei Hsien (TW); Chia-Hsiang Ou, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/189,121

(22) Filed: Aug. 8, 2008

(30) Foreign Application Priority Data

Apr. 28, 2008 (CN) ..... 2008 1 0301367

(51) Int. Cl.
*B21D 5/01* (2006.01)

(52) U.S. Cl. ..... 72/389.3; 72/387; 72/389.4; 72/389.8; 72/396

(58) Field of Classification Search ..... 72/387, 72/389.3, 389.4, 389.8, 396, 413
See application file for complete search history.

(56) References Cited

U.S. PATENT DOCUMENTS 2,882,952 A * 4/1959 Johnson ..... 72/396
2,916,073 A * 12/1959 Johnson ..... 72/396
5,007,278 A * 4/1991 Haberstock ..... 72/389.4
5,060,501 A * 10/1991 Heath ..... 72/389.74
5,295,385 A * 3/1994 Murai ..... 72/389.4
5,365,766 A * 11/1994 Takahashi et al. ..... 72/387
6,516,649 B1 2/2003 Mika et al.
6,644,091 B2 * 11/2003 Huang et al. ..... 72/389.3
6,672,127 B2 * 1/2004 Maida ..... 72/389.4
7,454,943 B2 * 11/2008 Jacobsen ..... 72/389.8

FOREIGN PATENT DOCUMENTS

JP 62-158527 * 7/1987
JP 63-199028 * 8/1988
JP 63-94918 * 4/1991
JP 3-124317 * 5/1991

* cited by examiner

*Primary Examiner*—David B Jones
(74) *Attorney, Agent, or Firm*—Frank R. Niranjan

(57) ABSTRACT

A press brake tool for bending a workpiece includes a punch having a punch tip, a press brake die and a die holder fixing the die thereto. The press brake die includes a pair of rotary members and at least one elastic member. The press brake die further defines an elongated lateral groove facing the punch tip and at least one longitudinal through hole communicating with the lateral groove. The pair of rotary members is spaced from each other and rotatably received in the elongated lateral groove. The at least one elastic member is received in the at least one longitudinal through hole and abutting the pair of rotary members.

5 Claims, 5 Drawing Sheets

PRESS BRAKE TOOL

BACKGROUND

1. Field of the Invention

The present invention relates to mechanical technology and, particularly, to a press brake tool.

2. Description of Related Art

A press brake tool commonly includes a punch, and a die that defines a groove to receive the punch.

FIG. 5 shows a die 61 of a typical press brake tool. The die 61 defines an elongated V-shaped groove 62 and two elongated C-shaped grooves 63 on respective sides of the V-shaped groove 62. The C-shaped grooves 63 are parallel to the V-shaped groove 62 and rotatably receive a cylindrical plug 64 therein. During punching, the cylindrical plugs 64 rotate in the C-shaped grooves 63 to reduce friction between the die 61 and a workpiece (not shown) in the die 61, thereby protecting the workpiece from damage.

However, after being punched, the workpiece is manually removed from the die 61, which is time-consuming.

Therefore, what is needed is to provide a press brake tool in which the described limitations are addressed.

SUMMARY

An exemplary press brake tool for bending a workpiece includes a punch having a punch tip, a press brake die, and a die holder for fixing the die thereto. The press brake die includes a pair of rotary members and at least one elastic member. The press brake die further defines an elongated lateral groove facing the punch tip and at least one longitudinal through hole communicating with the lateral groove. The pair of rotary members is spaced from each other and rotatably received in the elongated lateral groove. The at least one elastic member is received in the at least one longitudinal through hole, against the pair of the rotary members.

Other advantages and novel features of the present invention will become more apparent from the following detailed description of an embodiment/embodiments when taken in conjunction with the accompanying drawings.

DETAILED DESCRIPTION

Figure 1:
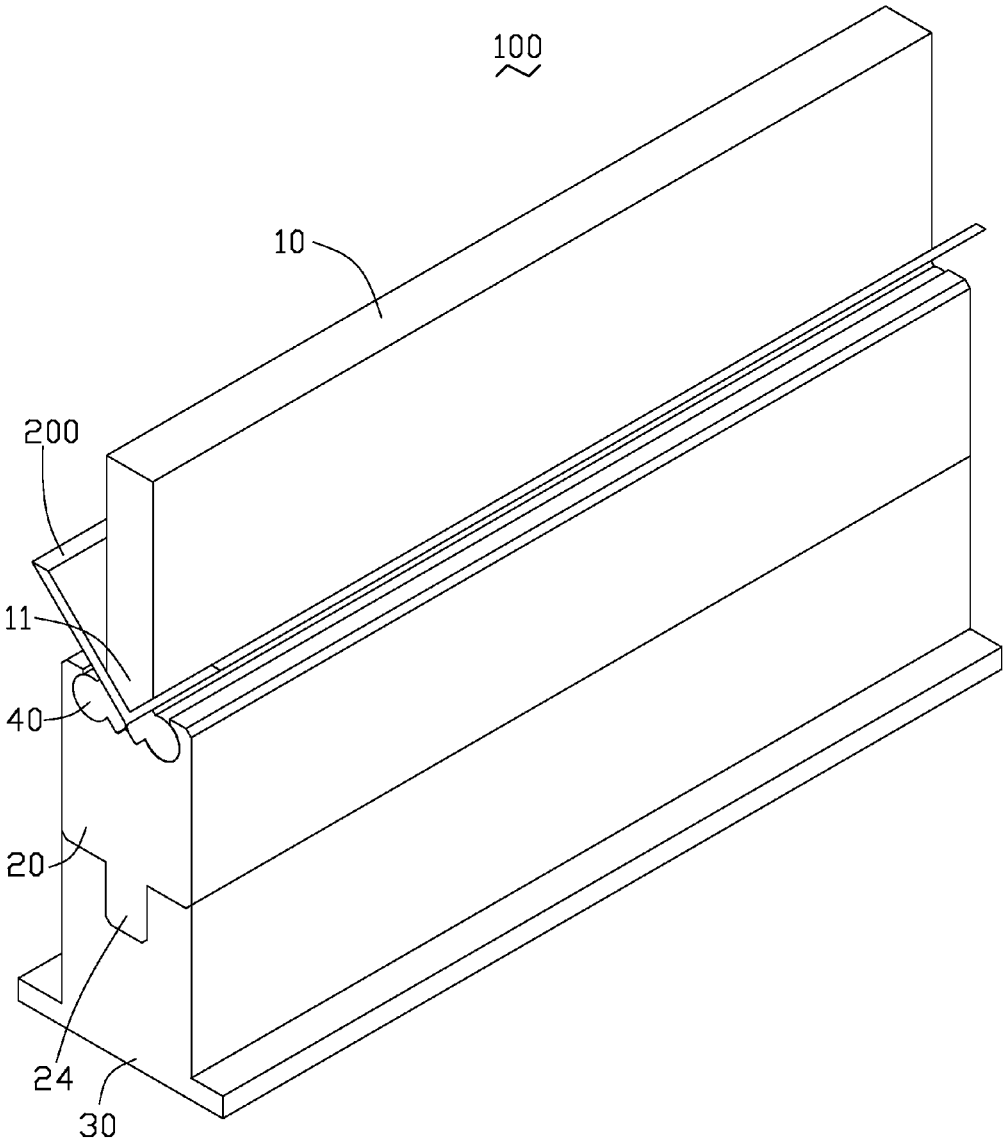
FIG. 1 is a schematic view of a press brake tool according to an exemplary embodiment, showing a workpiece to be punched.

Referring to FIG. 1, a press brake tool 100 for bending a workpiece 200 in accordance with an exemplary embodiment includes a punch 10, a press brake die 20, and a die holder 30. The punch 10 has a V-shaped punch tip 11. The die 20 is fixed to the die holder 30. The workpiece 200 is placed between the punch 10 and die 20, and can be bent when the punch 10 descends into the die 20.

Figure 2:
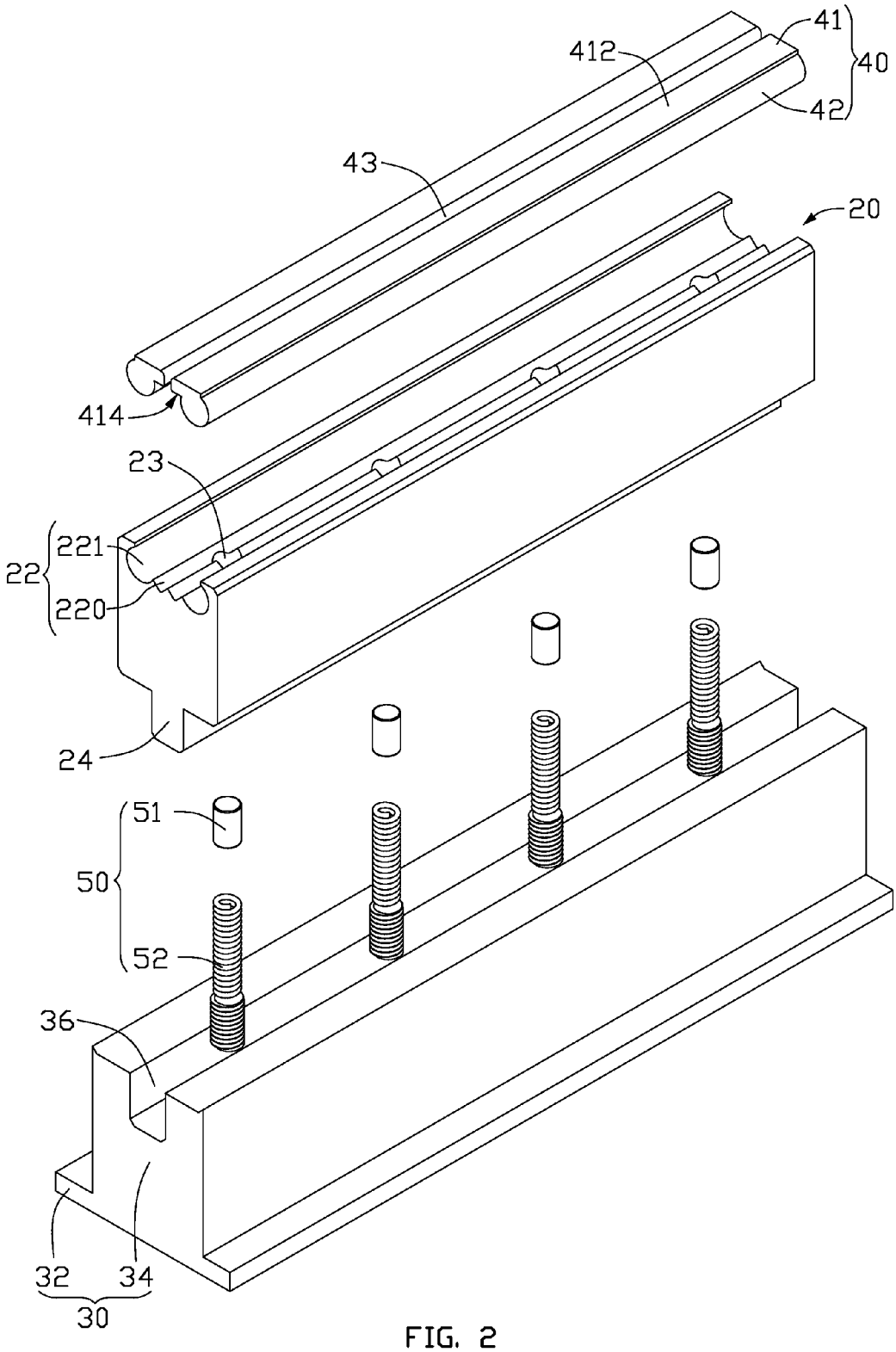
FIG. 2 is an exploded, isometric view of a press brake die of the press brake tool of FIG. 1.

Referring to FIGS. 1 and 2, the die holder 30 includes a base 32 and a receiving portion 34 extending perpendicularly from the base facing the die 20. An elongated recess 36 is defined on a terminal of the receiving portion 34 facing the die 20.

Figure 3:
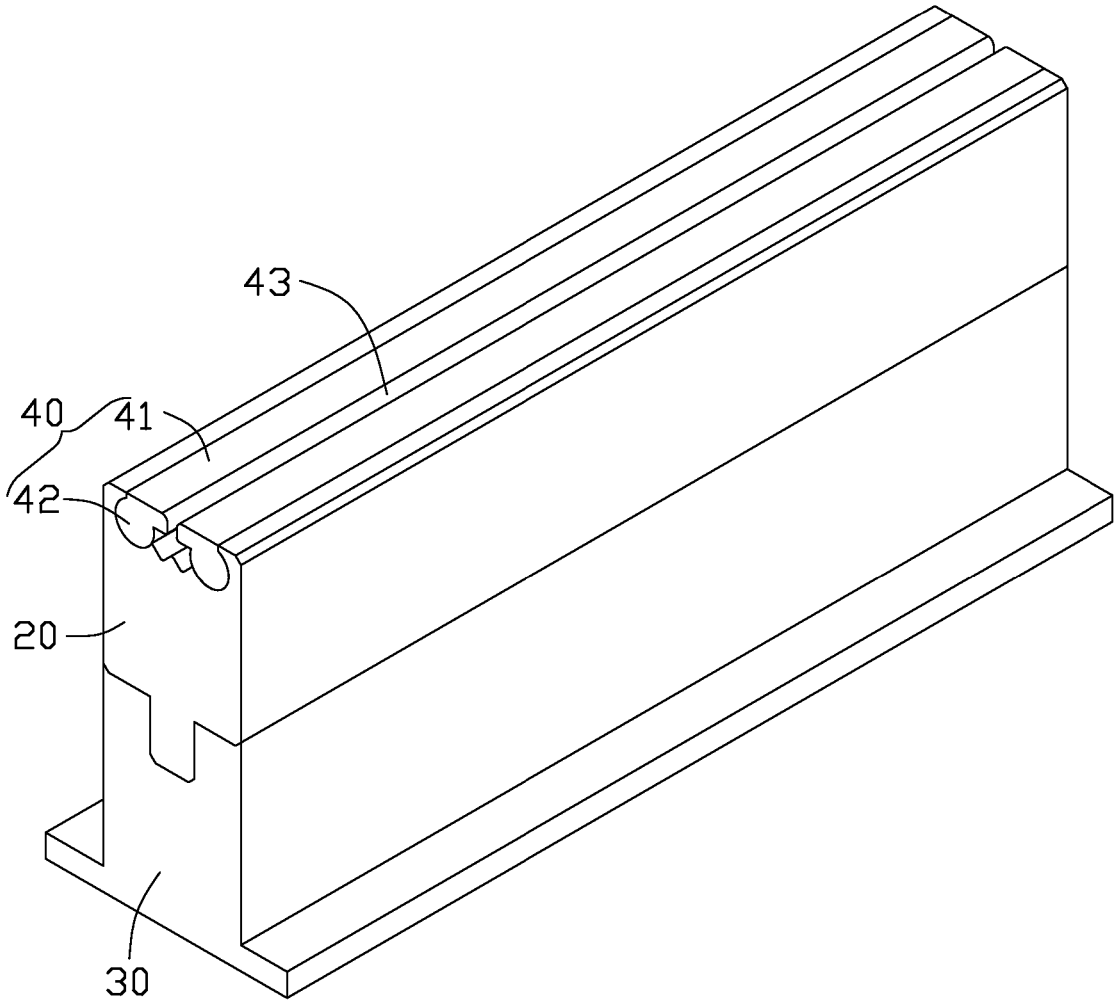
FIG. 3 is an assembled view of a press brake die of the press brake tool of FIG. 1, in an idle position.
Figure 4:
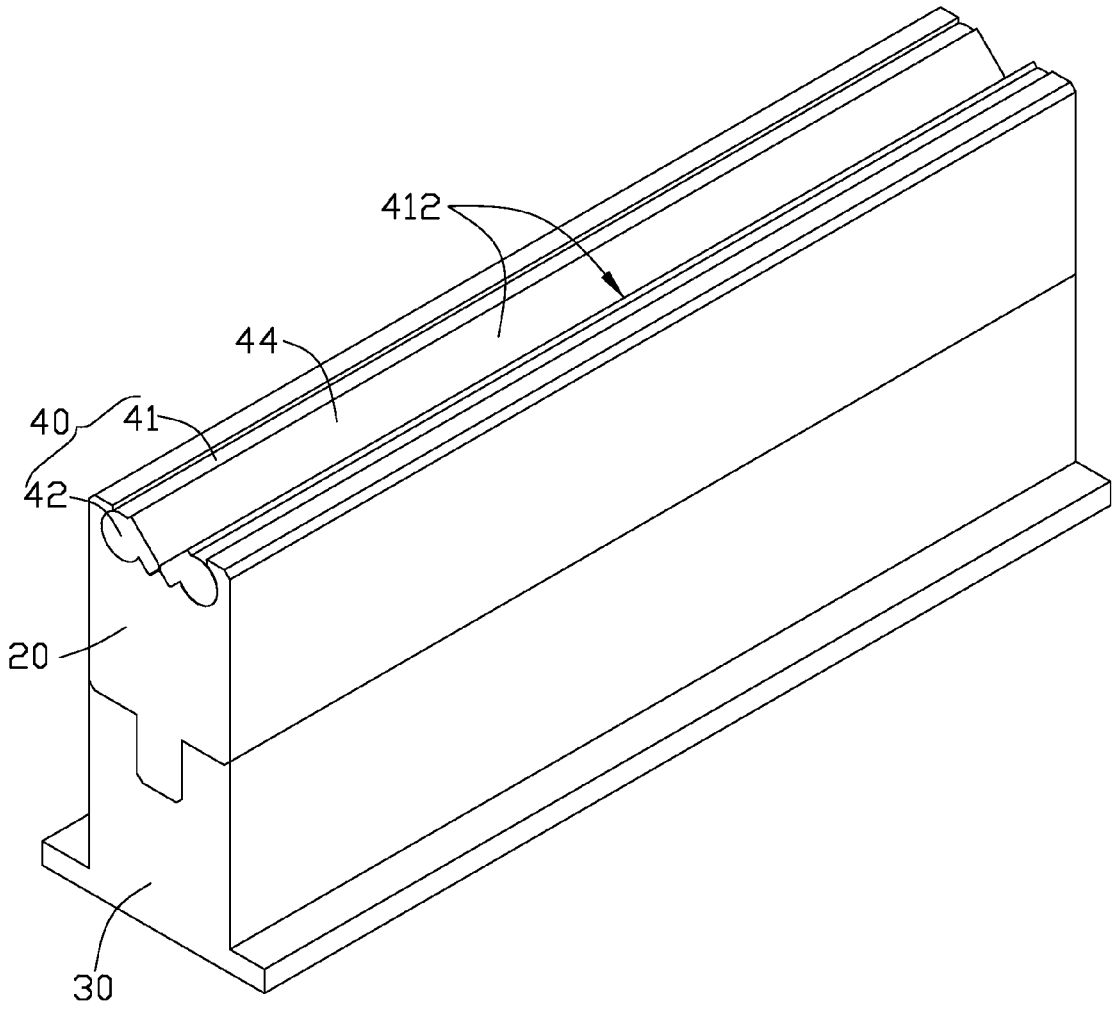
FIG. 4 is similar to FIG. 3, showing the press brake die in use.
Figure 5:
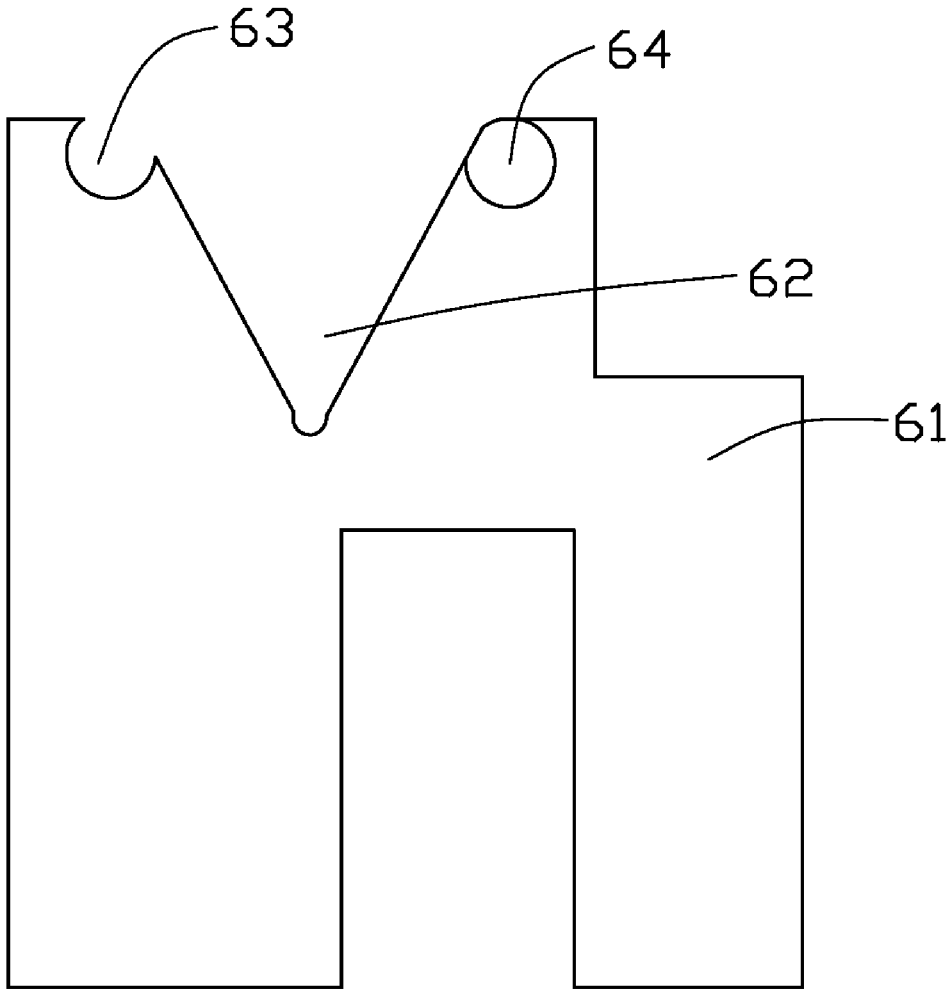
FIG. 5 (RELATED ART)
FIG. 5 is a plan view of a typical die used in a press brake tool.

Referring to FIGS. 2 to 4, the die 20 includes an elongated protrusion 24 facing the die holder 30, a pair of rotary members 40, and a number of elastic members 50. The elongated protrusion 24 is received in the elongated recess 36. The die 20 defines an elongated lateral groove 22, and a number of longitudinal through holes 23 communicating with the lateral groove 22 and functioning as extensions of the elastic members 50. The lateral groove 22 includes a recessed portion 220 with a W-shaped extremity and two C-shaped sub-grooves 221. The C-shaped sub-grooves 221 are respectively placed at opposite sides of the recessed portion 220, and communicate with the recessed portion 220.

The pair of rotary members 40 is spaced from each other, and a gap 43 is formed therebetween. The pair of rotary members 40 may form a configuration suitable for punching the workpiece 200 in response to the depression of the punch 10. Each rotary member 40 includes a curved portion 42 rotatably received in a corresponding C-shaped sub-groove 221, and an elongated contact portion 41 integrated with the arc portion 42. The elongated contact portion 41 includes an upper surface 412 smoothly contacting the workpiece 200, and a lower surface 414 opposite to the upper surface 412 abutting the elastic members 50 and subsequently received in the recessed portion 220 when the workpiece 200 is bent.

Each elastic member 50 includes a restore block 51 and an elastic element 52 e.g., a compression spring. An end of the restore block 51 abuts the lower surface 414 of the contact portion 41, and the other end of the restore block 51 is connected to an end of the elastic element 52. Another end of the elastic element 52 is fixed to the die holder 30. In this way, the elastic members 50 impel the rotary members 40 to expel the punched workpiece 200 from the die 20.

During a bending operation of the workpiece 200 (referring to FIG. 1), the punch tip 11 descends into the die 20. The workpiece 200 presses the two upper surfaces 412 of the contact portions 41, and as a result, the pair of rotary members 40 rotate in the lateral groove 22 until the lower surface 414 is received and stopped in the recessed portion 220. At this time, the restore blocks 51 of the elastic members 50 are pressed downwardly by the contact portion 41 using the lower surface 414, thereby compressing the elastic elements 52, and a V-shaped groove 44 is formed between the two upper surfaces 412 of the contact portions 41. After the workpiece 200 is punched, the punch 10 moves upwardly. The elastic element 52 releases to impel the restore block 51 to an original position of the restore block 51, and as a result, the pair of rotary members 40 rotates to eject the bent workpiece 200 from the die 20.

The bent workpiece 200 can be automatically ejected by the pair of rotary members 40 of the press brake tool 100. Therefore, the time for completing a bending operation of the workpiece 200 is reduced.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A press brake tool for bending a workpiece, the tool comprising:

a punch having a punch tip;

a press brake die including a pair of rotary members and at least one elastic member, and the press brake die defining an elongated lateral groove facing the punch tip and at least one longitudinal through hole communicating with the lateral groove, the pair of rotary members spaced from each other and rotatably received in the elongated lateral groove, the at least one elastic member received in the at least one longitudinal through hole and abutting the pair of the rotary members; and a die holder fixing the die thereto;

wherein the elongated lateral groove includes a recessed portion with a W-shaped extremity, and two C-shaped sub-grooves respectively disposed at opposite sides of the recessed portion and communicating with the recessed portion; each rotary member includes a curved portion rotatably received in a corresponding C-shaped sub-groove and an elongated contact portion integrated with the curved portion; the elongated contact portion includes a smooth upper surface smoothly contacting the workpiece and a lower surface opposite to the upper surface abutting the elastic members and subsequently received in the recessed portion when the workpiece is bent.

2. The press brake tool as claimed in claim 1, wherein the at least one elastic member includes a restore block and an elastic element; with an end of the restore block abutting the lower surface, and the other end of the restore block connected to an end of the elastic element.

3. The press brake tool as claimed in claim 2, wherein the elastic element is a compression spring.

4. The press brake tool as claimed in claim 1, wherein the die holder includes a base and a receiving portion extending perpendicularly from the base facing the die, and an elongated recess is defined on a terminal of the receiving portion facing the die.

5. The press brake tool as claimed in claim 4, wherein the die comprises an elongated protrusion facing the die holder and received in the elongated recess.

* * * * *